US008033266B2

(12) United States Patent
Akagi et al.

(10) Patent No.: US 8,033,266 B2
(45) Date of Patent: Oct. 11, 2011

(54) THROTTLE VALVE CONTROLLER FOR INTERNAL COMBUSTION ENGINE

(75) Inventors: Yoshihiko Akagi, Hitachinaka (JP); Hidefumi Iwaki, Hitachinaka (JP); Kenji Ono, Mito (JP)

(73) Assignee: Hitachi, Ltd., Tokyo (JP)

( * ) Notice: Subject to any disclaimer, the term of this patent is extended or adjusted under 35 U.S.C. 154(b) by 701 days.

(21) Appl. No.: 11/945,657

(22) Filed: Nov. 27, 2007

(65) Prior Publication Data

US 2008/0141976 A1 Jun. 19, 2008

(30) Foreign Application Priority Data

Dec. 13, 2006 (JP) ..... 2006-335229

(51) Int. Cl.
*F02D 41/00* (2006.01)

(52) U.S. Cl. ..... 123/361; 123/399

(58) Field of Classification Search ..... 123/319, 123/339.1, 339.16, 339.17, 339.18, 361, 123/399, 376, 402, 403
See application file for complete search history.

(56) References Cited

U.S. PATENT DOCUMENTS

| | | | | |
|---|---|---|---|---|
| 4,457,275 | A * | 7/1984 | Hosokai et al. | 123/339.21 |
| 4,781,162 | A * | 11/1988 | Ishikawa et al. | 123/399 |
| 4,787,353 | A * | 11/1988 | Ishikawa et al. | 123/399 |
| 4,791,902 | A * | 12/1988 | Ishikawa et al. | 123/399 |
| 4,919,096 | A * | 4/1990 | Manaka et al. | 123/399 |
| 5,343,783 | A * | 9/1994 | Tanaka et al. | 477/131 |
| 5,390,632 | A * | 2/1995 | Ikebe et al. | 123/41.02 |
| 6,109,236 | A * | 8/2000 | Takahashi et al. | 123/339.19 |
| 7,051,726 | B1 * | 5/2006 | Muto et al. | 123/684 |
| 7,052,434 | B2 * | 5/2006 | Makino et al. | 477/107 |
| 7,121,258 | B2 * | 10/2006 | Nakamoto et al. | 123/399 |
| 7,150,263 | B2 * | 12/2006 | Kishi et al. | 123/319 |
| 2005/0022762 | A1 * | 2/2005 | Machida | 123/90.17 |
| 2005/0183696 | A1 * | 8/2005 | Soshino et al. | 123/399 |
| 2005/0199215 | A1 * | 9/2005 | Nakamoto et al. | 123/395 |

FOREIGN PATENT DOCUMENTS

JP 8074639 A 3/1996

* cited by examiner

*Primary Examiner* — John Kwon
(74) *Attorney, Agent, or Firm* — Crowell & Moring LLP

(57) ABSTRACT

A throttle valve controller for an internal combustion engine has a throttle valve driven by a motor. The target opening of the throttle valve is determined based on the operating state of the vehicle or internal combustion engine. A first lower limit is determined beforehand as the minimum target opening, and a second lower limit is set which is smaller than the first lower limit if the determined target opening is smaller than a predetermined opening and/or if the rotation speed of the internal combustion engine is lower than a predetermined speed.

4 Claims, 15 Drawing Sheets

THROTTLE VALVE CONTROLLER FOR INTERNAL COMBUSTION ENGINE

BACKGROUND OF THE INVENTION

1. Field of the Invention

The present invention relates to a throttle valve controller for internal combustion engines.

2. Description of the Related Art

In JP-A-8-74639, a technique is described which uses two closing limiters when fully closing a throttle valve. Namely, after the opening of the throttle valve is reduced to a first lower limit which is set a little higher than a second lower limit set as the target degree of opening, the throttle valve is closed to the second limit at a certain speed.

SUMMARY OF THE INVENTION

If a throttle valve is moved toward the mechanical full close position at high speed, the throttle valve may overshoot and bump against the full close position. This may cause a large impact, resulting in damage, deformation and other troubles. To prevent such damage, deformation and the like, a closing limiter is set for the target degree of opening by software sufficiently before the mechanical full close position. However, in the case of vehicles having wide control ranges of engine power, especially fuel efficiency-critical vehicles such as HEVs and CVT-employed ones, it is required to further improve in fuel efficiency, for example at idle by reducing the air demand and lowering the closing limit to minimize the rotation speed.

It is an object of the present invention to secure a margin to prevent the throttle valve from being damaged or deformed at the full close position while attaining lowered fuel consumption or improved fuel efficiency.

The above-mentioned object is attained by a throttle valve controller for an internal combustion engine, which comprises: a throttle valve which is driven by a motor; means for determining the target opening of the throttle valve based on the operating state of the vehicle or internal combustion engine; a first lower limit which is determined beforehand as the minimum target opening; and means for setting a second lower limit which is smaller than the first lower limit if the determined target opening is smaller than a predetermined opening and/or if the rotation speed of the internal combustion engine is lower than a predetermined speed.

The above-mentioned object is also attained by a throttle valve controller for an internal combustion engine, which comprises: a throttle valve which is driven by a motor; means for determining the target opening and target throttle change speed of the throttle valve based on the operating state of the vehicle or internal combustion engine; a first lower limit which is determined beforehand as the minimum target opening; and means for setting a second lower limit which is smaller than the first lower limit if the determined target throttle change speed is lower than a predetermined speed.

By using a conventional throttle valve without making costly modifications such as adding components and machining, the present invention determines the lower limit of the target throttle opening so as to minimize the throttle opening or the air mass flow, for example, when the engine is at idle while securing a margin to prevent collision due to overshoot. Thus, the engine power can be controlled more widely, enabling improvement of HEVs, CVT-employed vehicles and other high fuel-efficiency vehicles in drivability.

DETAILED DESCRIPTION OF THE PREFERRED EMBODIMENTS

A first embodiment of the present invention will be described with reference to FIGS. 1 through 11.

First Embodiment

Figure 1:
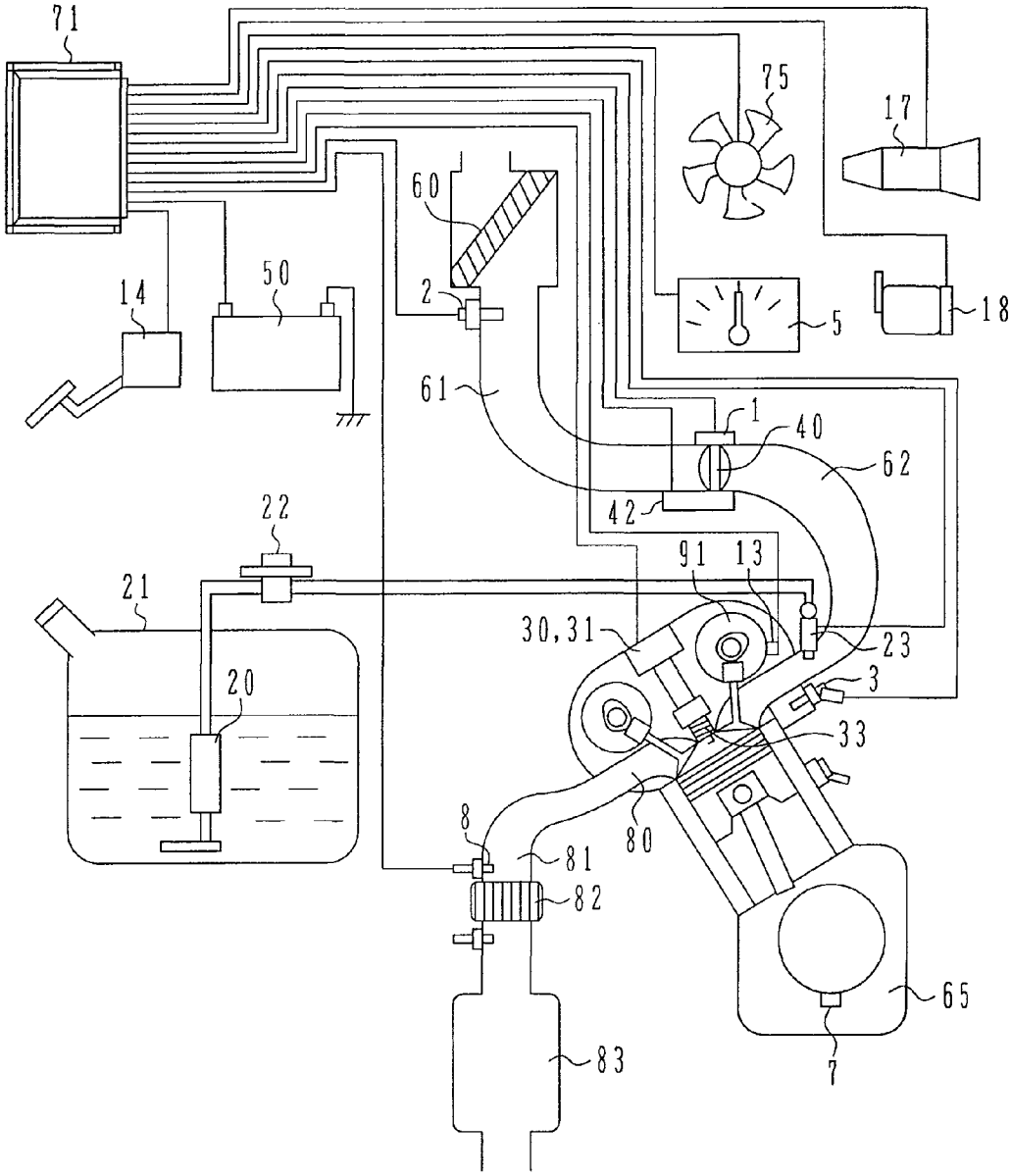
FIG. 1 shows the configuration of a control system.

The following describes an in-line four-cylinder internal combustion engine of the known MPI (multi-point injection) type which is shown in FIG. 1 as an embodiment. Air, inhaled into the internal combustion engine 65, passes an air cleaner 60 and is guided to a hot-wire air mass flow sensor 2 which uses a hot-wire sensor. From this hot-wire air mass flow sensor 2, a signal indicative of the intake air mass flow is output. As well, a signal indicative of the intake air temperature measured by a thermistor-used intake air temperature sensor is output. Then, the intake air goes through a duct 61 and passes a throttle valve 40 which controls the air mass flow entering the collector 62. The throttle valve is moved by a throttle drive motor 42 which is controlled by an ECU 71. The air which enters the collector 62 is distributed to the respective intake pipes which are directly connected to the engine for inhalation into the cylinders. The valve system is provided with a valve timing variable mechanism to set the angle as desired by performing feedback control. From a crank angle sensor 7 attached to the cylinder block, a pulse is output to the control unit 71 each time the crank passes a predetermined angle.

Fuel is pumped up from a fuel tank 21 and pressurized by a fuel pump 20 and regulated to a certain pressure by a pressure regulator 22 for injection into the intake pipes from injectors 23 provided on the intake pipes.

The throttle valve 40 has a throttle sensor 1 attached thereto which detects the degree of opening of the throttle valve. A sensor signal therefrom is input to the control unit 71 to perform feedback control of the opening of the throttle valve 40 and detect the full close position, acceleration and the like. The degree of opening targeted by this feedback control is determined from the displacement of the accelerator pedal pushed down by the driver and detected by an accelerator position sensor 14 and is dependent on idle speed control (ISC).

The internal combustion engine 65 has a water temperature sensor 3 mounted thereon to detect the temperature of the cooling water. Its sensor signal is input to the control unit 71 for use in detecting the warm-up condition of the internal combustion engine 65, increasing the fuel injection quantity, correcting the ignition timing, turning ON/OFF a radiator fan 75 and setting the target rotation speed at idle. In addition, the engine is provided with an air conditioner switch 18 to monitor the status of the air conditioner clutch and a neutral switch 17 incorporated in the transmission to monitor the status of the drive system.

An air-fuel ratio sensor 8 is mounted on an exhaust pipe of the engine and outputs a signal indicative of the oxygen concentration in the exhaust gas. This signal is input to the control unit 71 for use in adjusting the fuel injection pulse width so as to attain the target air-fuel ratio which is determined according to the driving condition.

Figure 2:
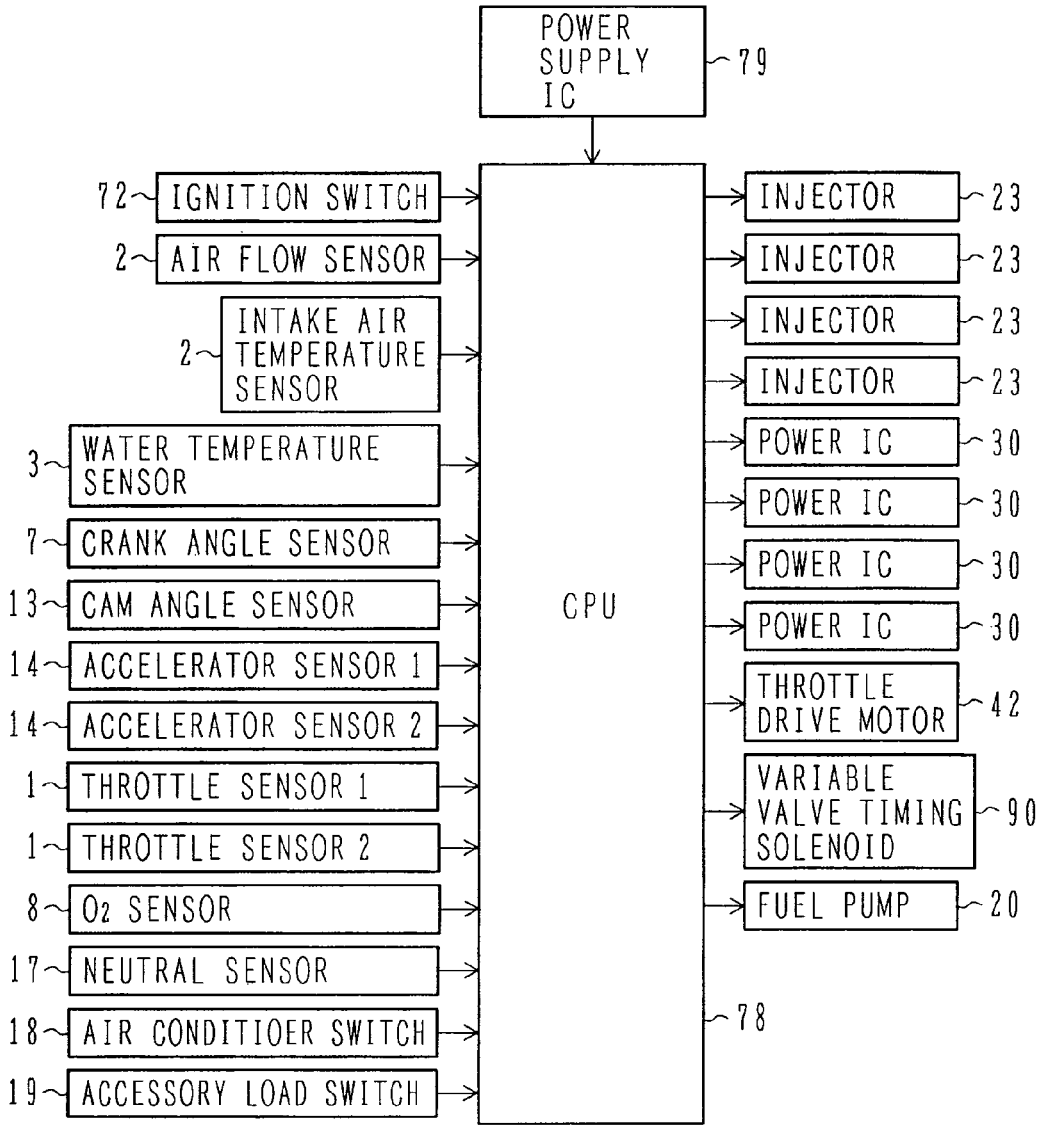
FIG. 2 shows a control unit.

The control unit 71 includes a CPU 78 and a power supply IC 79 as shown in FIG. 2. Input signals to the control unit 71 and others are summarized here with reference to this figure. The input signals include those from an air flow sensor 2, an intake air temperature sensor 2 incorporated therein, a crank angle sensor 7, throttle sensors 1, an air-fuel ratio sensor 8 and a water temperature sensor 3. The output signals from the control unit 71 include those to injectors 23, a fuel pump 20 and a power transistor 30 having ignition switches for spark plugs 33 and others.

Figure 3:
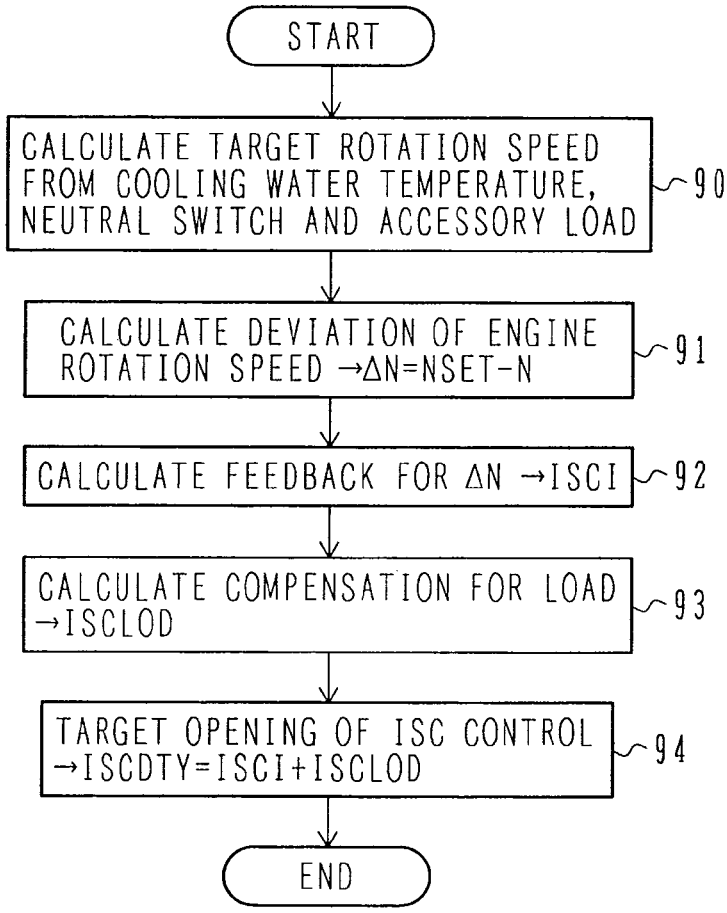
FIG. 3 shows means for idle rotation speed feedback control.
Figure 4:
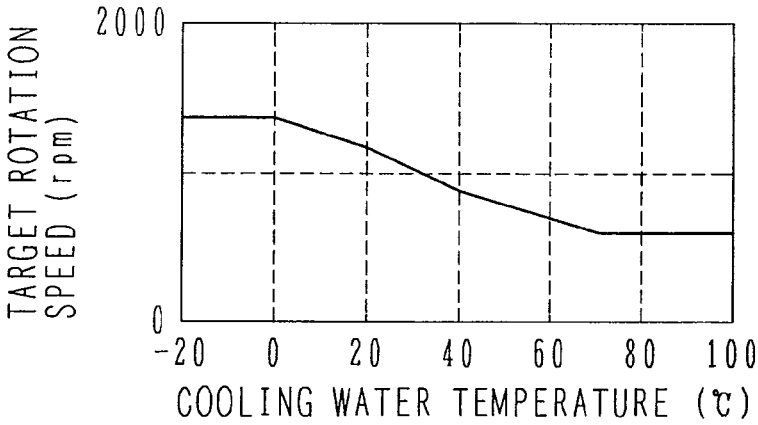
FIG. 4 shows means for setting the target rotation speed.
Figure 5:
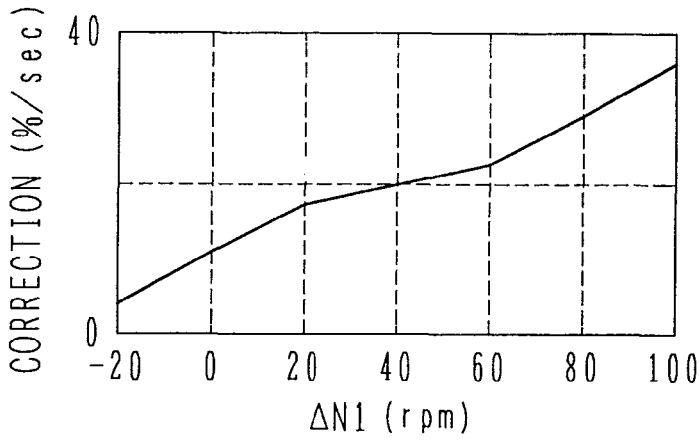
FIG. 5 shows means for calculating the amount of correction for ISC control.
Figure 6:
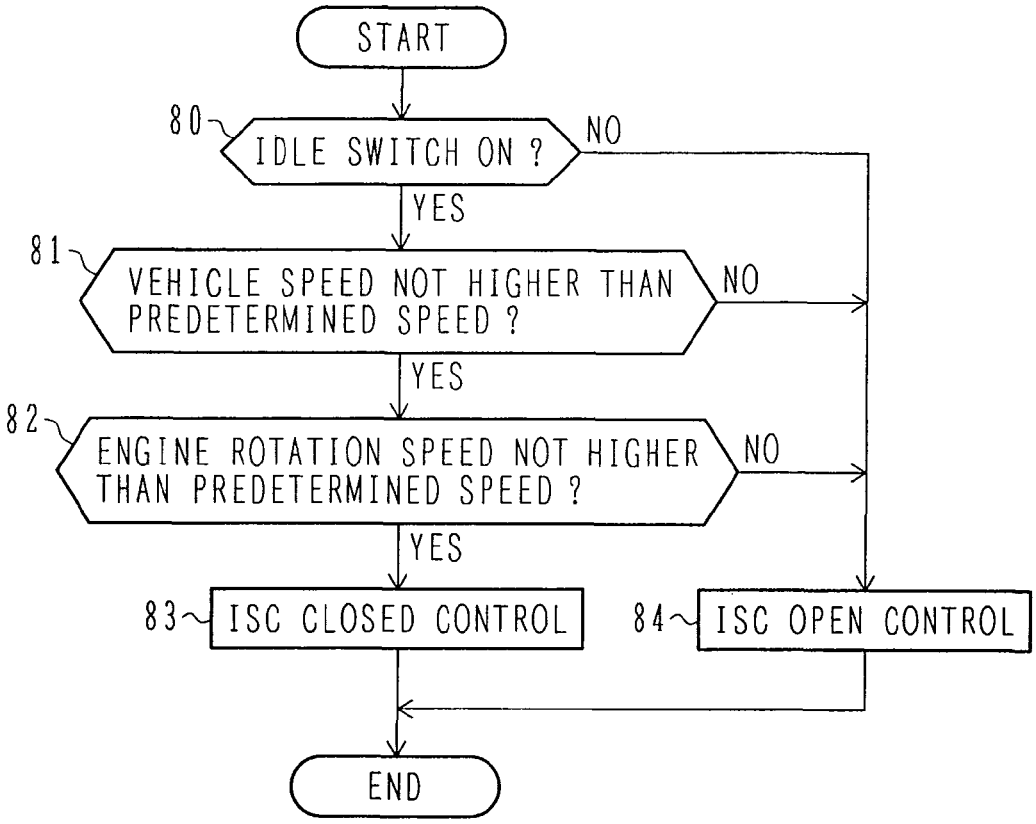
FIG. 6 shows means for enabling ISC closed control.

With reference to FIG. 3, the following describes the ISC control process in detail. In step 90, target rotation speed NSET is calculated according to a target rotation speed associated with the engine water temperature detected by the water temperature sensor 6, which is retrieved from a characteristic table shown in FIG. 4, the status of the neutral switch and the detected accessory load. In step 91, engine ration speed deviation ΔN is calculated from target rotation speed NSET and actual engine rotation speed. In step 92, feedback ISCI for ΔN is retrieved from a characteristic table shown in FIG. 5. In step 93, load compensation ISCLOD is calculated according to the results of detecting the air conditioner load switch and electrical load switch. In step 94, ISC target opening ISCDTY is determined by adding ISCI and ISCLOD.

ISC control is performed at idle. Whether to enable the ISC control is judged based on the flows of FIG. 6. In step 80, the idle switch is judged as ON if the accelerator position sensor indicates the accelerator is fully closed. In this case, the idle switch ON condition is met. In step 81, it is judged whether the vehicle speed is not higher than a predetermined speed. In step 82, it is judged whether the engine rotation speed is not higher than a predetermined speed. If steps 80 through 82 are all true, the ISC CLOSED control condition is met. In this case, ISC control is performed.

Figure 7:
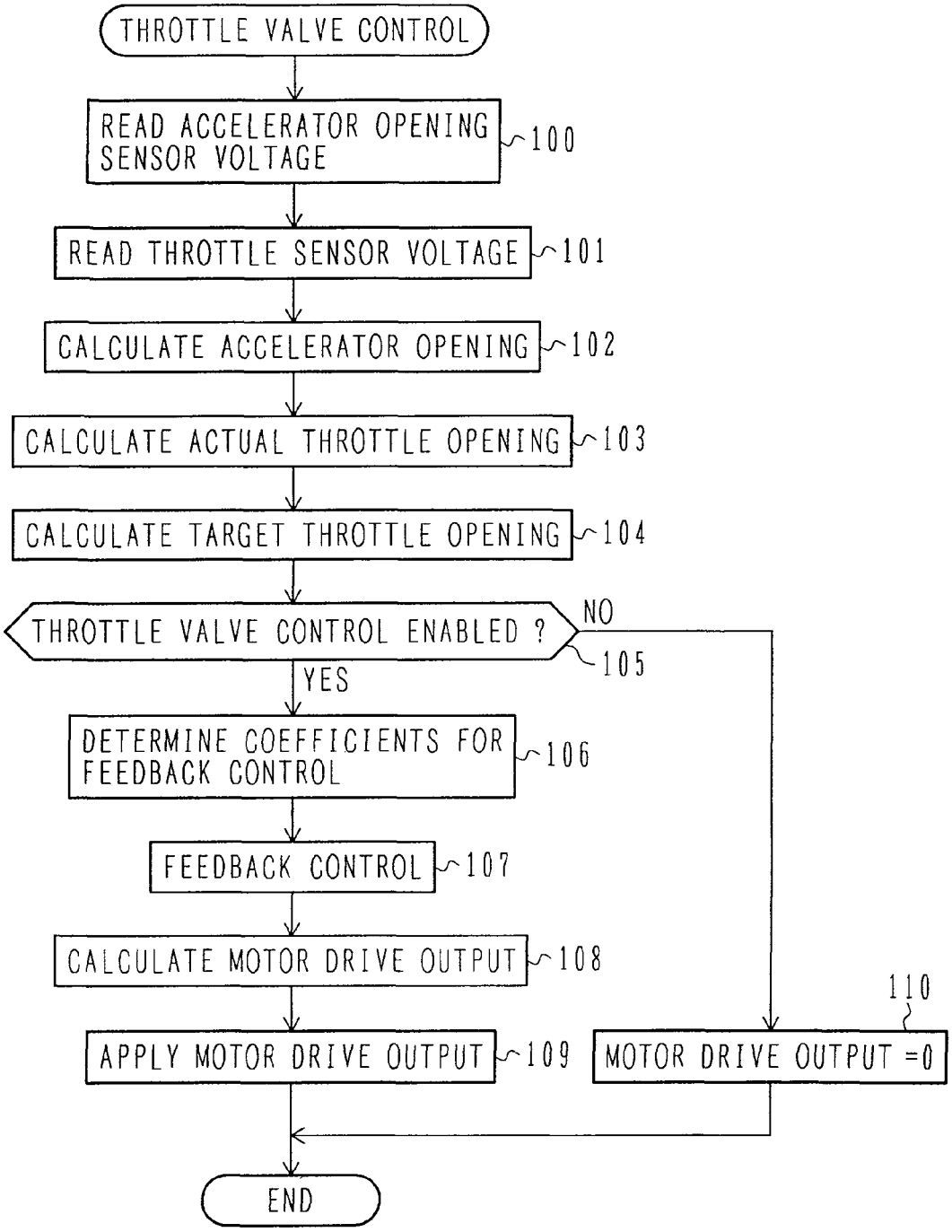
FIG. 7 is a flowchart of throttle valve control.

FIG. 7 is a flowchart of the throttle valve control to which the present invention is applied. In the figure, the accelerator position sensor 14 voltage is read in (step 100), the throttle sensor 1 voltage is read in (step 101), the accelerator opening is calculated (step 102) and the actual throttle valve position is calculated (step 103). Then, the target throttle opening is calculated (step 104) and it is judged whether the throttle valve is to be enabled (step 105). If Yes, coefficients for the feedback control are determined (step 106), and the feedback control is performed (step 107). Then, the motor drive output is determined (step 108) and the motor drive output is applied (step 109) before the sequence is completed. If No, the process is completed with the motor drive output set to 0 (step 110).

Figure 8:
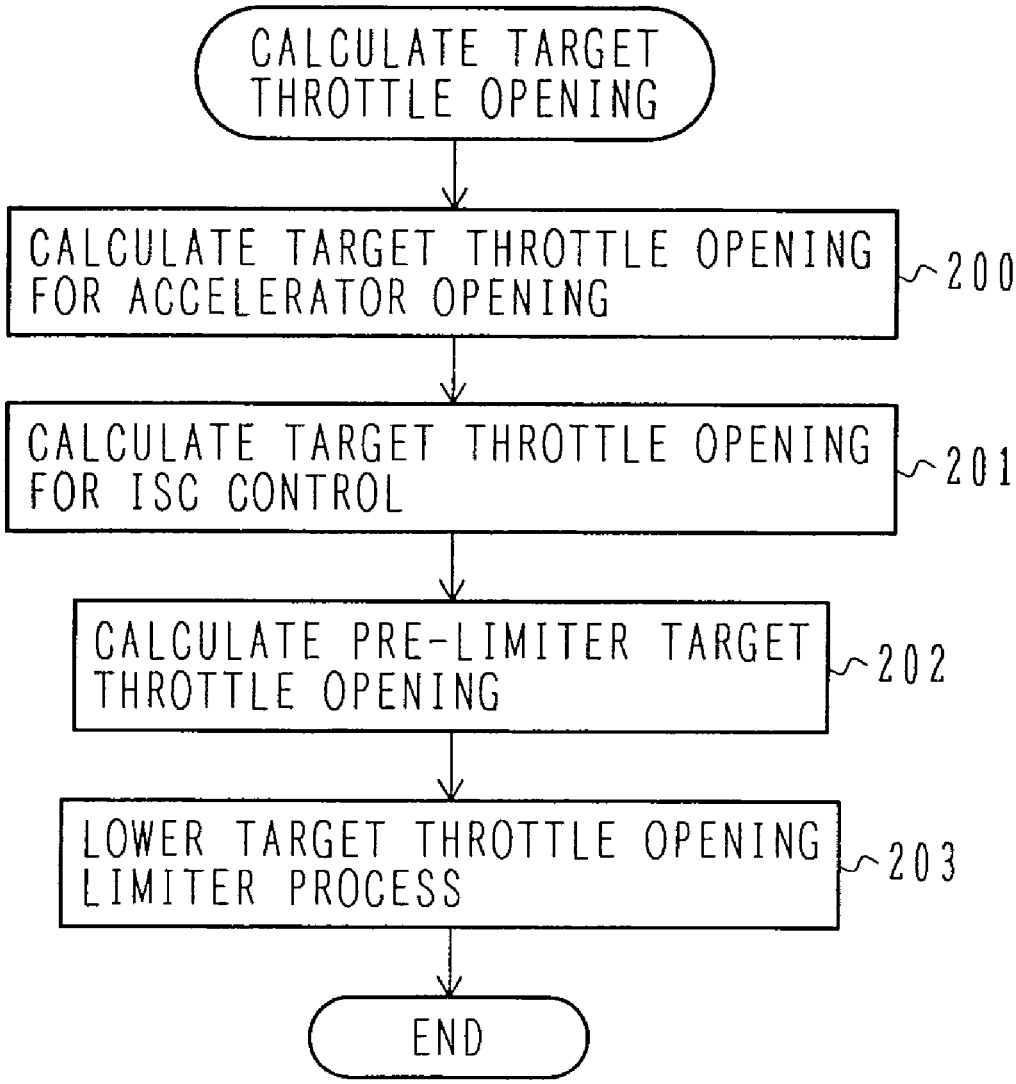
FIG. 8 is a detailed flowchart of target throttle opening calculation.

FIG. 8 is a detailed flowchart of the target throttle opening calculation step (step 104) in FIG. 7.

In the figure, the target throttle opening for the accelerator position is calculated (step 200) and the target throttle opening for the idle speed control is calculated (step 201) by using the process of FIG. 3. Then, the target throttle opening is calculated (step 202) without limiting the target throttle opening. Simply, the target throttle opening is calculated from the sum of the target throttle opening for the accelerator position and the target throttle opening for the idle speed control. Then, a process to limit the target throttle opening is performed (step 203) before the sequence is completed.

Figure 9:
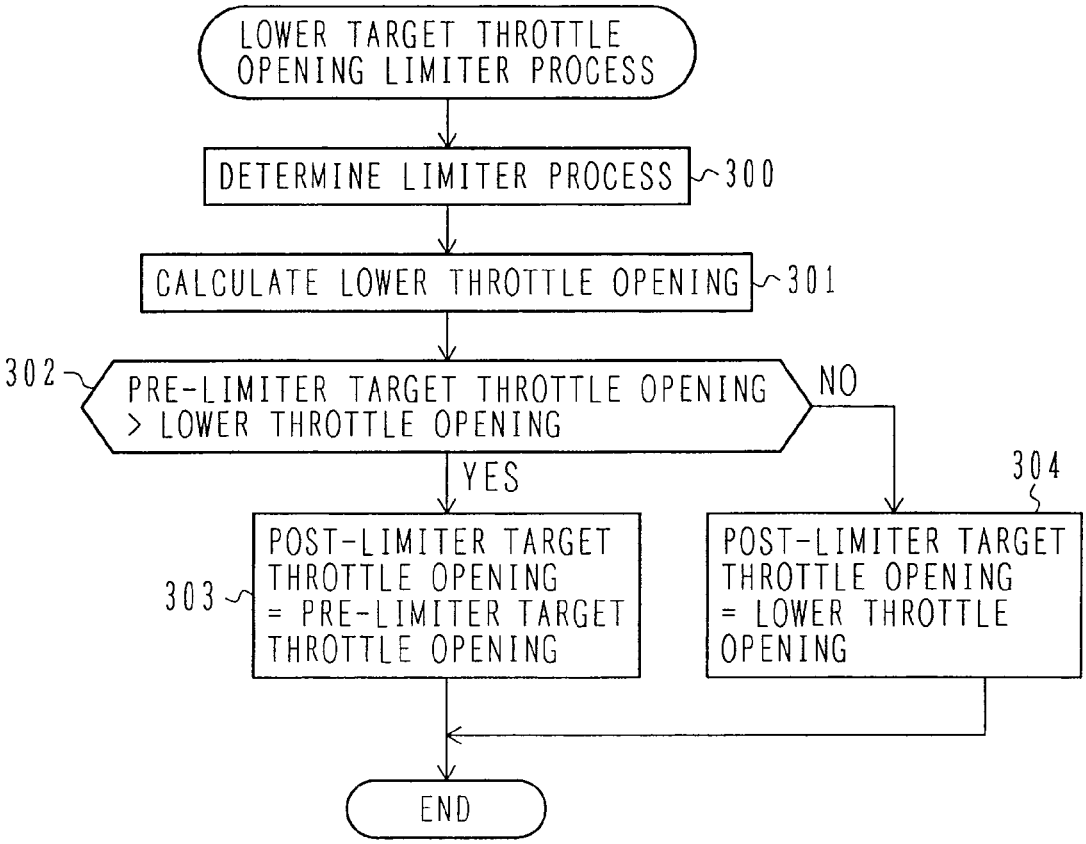
FIG. 9 is a detailed flowchart of target throttle opening limiter process.

FIG. 9 is a detailed flowchart of the target throttle opening limiter process (step 202) in FIG. 8.

In the figure, which lower limiter is to be used is determined (step 300) and a lower limit is calculated (step 301). A pre-limiter target opening is then compared with the lower limit (step 302). If the pre-limiter target opening is larger than the lower limit (yes), the pre-limiter target opening is set as the post-limiter target opening (step 303) before the sequence is completed. If the pre-limiter target opening is not larger than the lower limit (no), the lower limit is set as the post-limiter target opening (step 304) before the sequence is completed.

Figure 10:
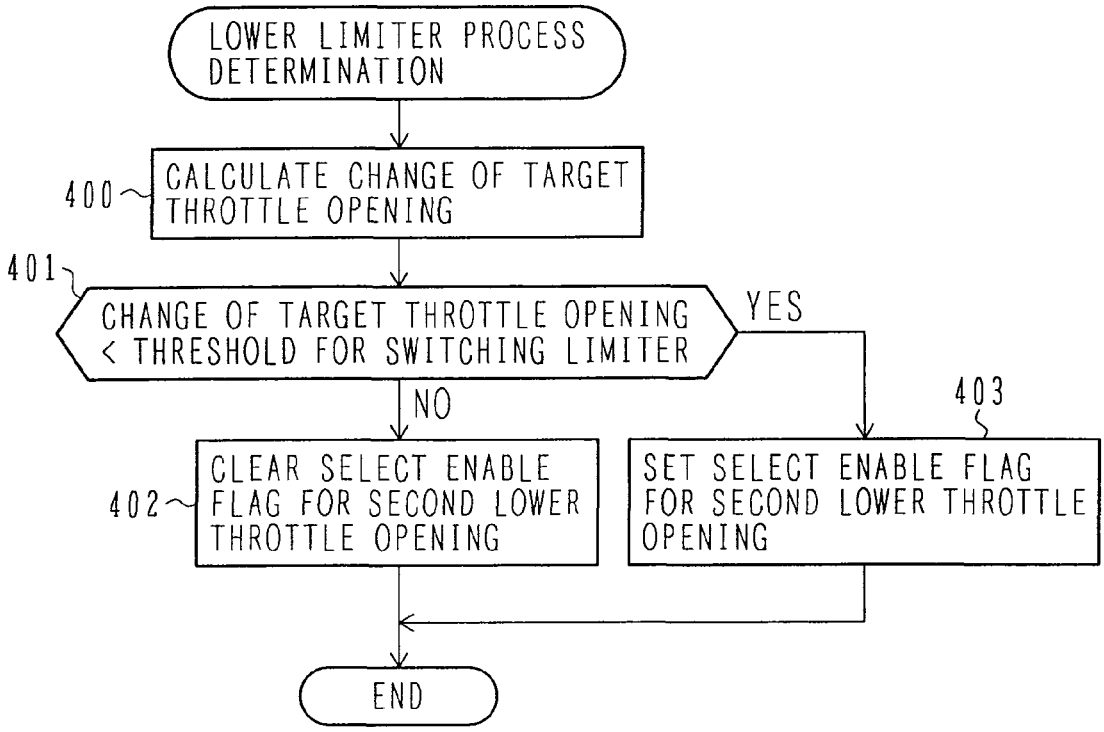
FIG. 10 is a detailed flowchart of lower limiter determination.

Then, the following describes FIG. 10 which shows a detailed flowchart of the lower limiter determination step (step 300) included in FIG. 9. Change in the target throttle opening is calculated (step 400). The change in the target throttle opening is compared with a predetermined lower limiter switching threshold, and it is judged whether or not the value obtained is smaller than the threshold (step 401). The predetermined threshold means relationship in which overshoot will not occur in the relation between change in the target throttle opening and a throttle opening. If the value obtained is not higher than the threshold (YES), an enable flag to select a second lower limiter is set (step 403) before the sequence is completed. If the value obtained is not smaller than the threshold (NO), the enable flag to select the second lower limiter is cleared (step 402) before the sequence is completed.

Figure 11:
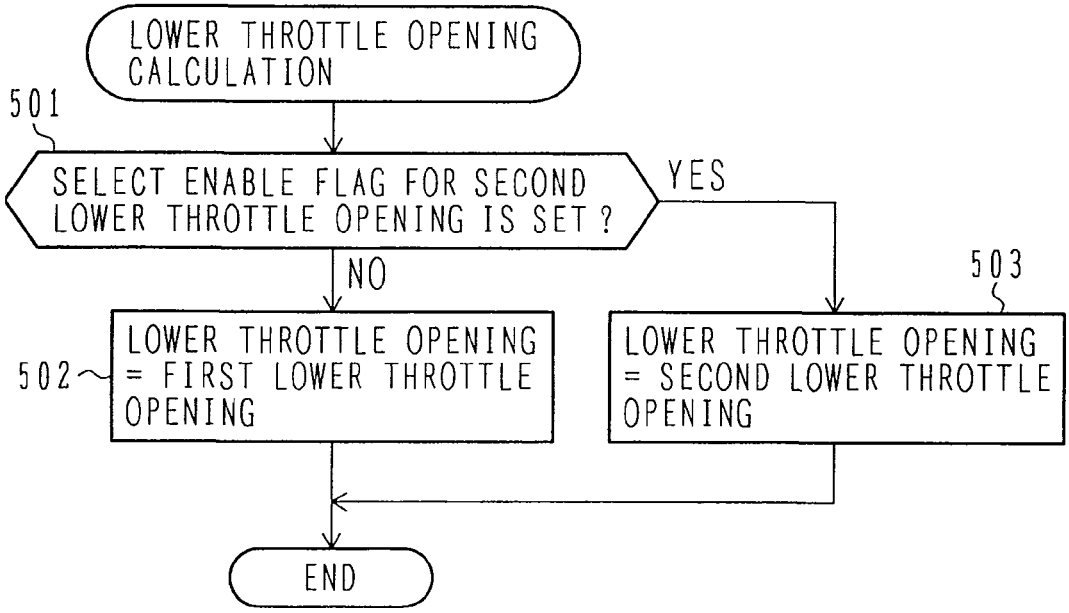
FIG. 11 is a detailed flowchart of lower limit calculation.

Then, the following describes FIG. 11 showing a flowchart of the lower limit calculation step (step 301) in FIG. 9.

In the figure, it is judged whether the enable flag to select the second lower limiter is set (step 501). If the enable flag to select the second lower limiter is set (yes), the predetermined second lower limit smaller than the first lower limit is set as the lower limit (step 503) before the sequence is completed.

If the enable flag to select the second lower limit is not set (no), the predetermined first lower limit larger than the second lower limit is set as the lower limit (step 502) before the sequence is completed.

The above-mentioned process can make the lower limit smaller if the change of the target throttle opening is so small as not to cause overshoot. It is therefore possible to extend the throttle position control range toward the full close position without causing collision at the mechanical full close position.

Second Embodiment

A second embodiment of the present invention is described below.

Figure 12:
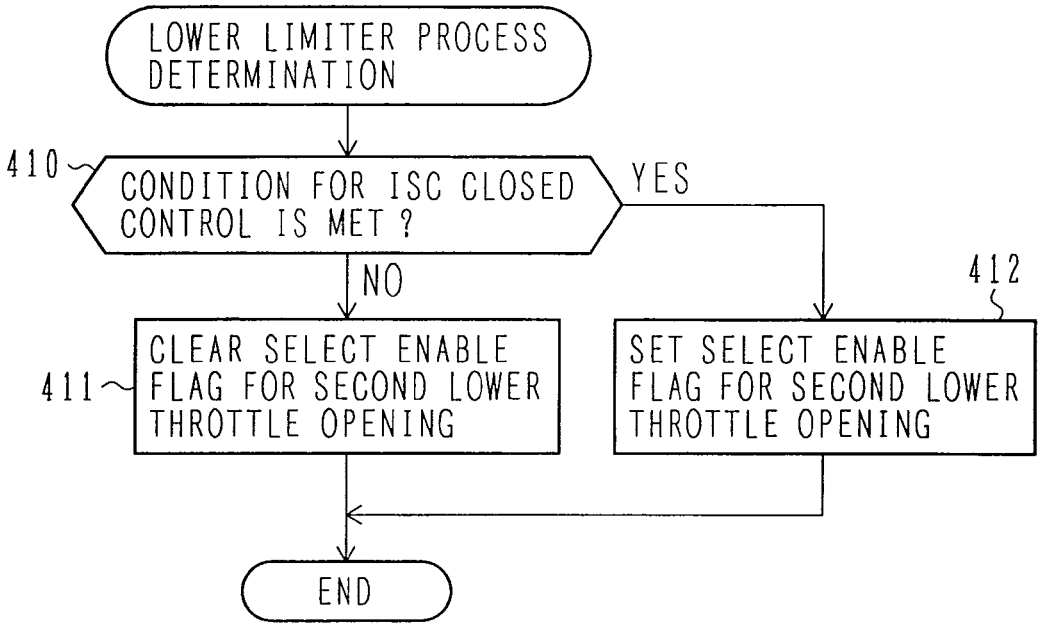
FIG. 12 shows a second method of lower limiter determination.

The lower limiter determination method of the second embodiment is different from that of the first embodiment. The following describes FIG. 12 where its flowchart is shown.

It is judged whether the ISC closed control condition is met by the current throttle position, that is, overshoot is not expected to occur (step 410). If met (yes), an enable flag to select a second lower limiter is set (step 412) before the sequence is completed. If not met (no), the enable flag to select the second lower limiter is cleared (step 411) before the sequence is completed.

Third Embodiment

A third embodiment of the present invention is described below.

Figure 13:
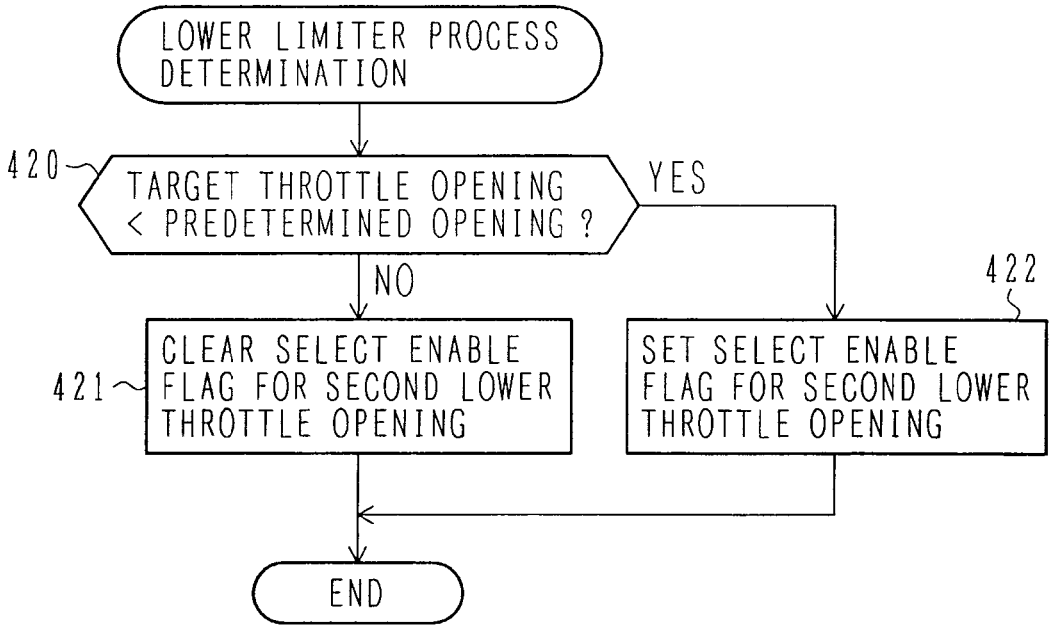
FIG. 13 shows a third method of lower limiter determination.

The lower limiter determination method of the third embodiment is different from that of the first embodiment. The following describes FIG. 13 where its flowchart is shown.

It is judged whether the target throttle opening is smaller than a predetermined throttle opening (step 420). If the target throttle opening is smaller than the predetermined throttle opening, the throttle valve is not likely to overshoot. In this case (yes), an enable flag to select a second lower limiter is set (step 422) before the sequence is completed. If not smaller (no), the enable flag to select the second lower limiter is cleared (step 421) before the sequence is completed.

Fourth Embodiment

A fourth embodiment of the present invention is described below.

Figure 14:
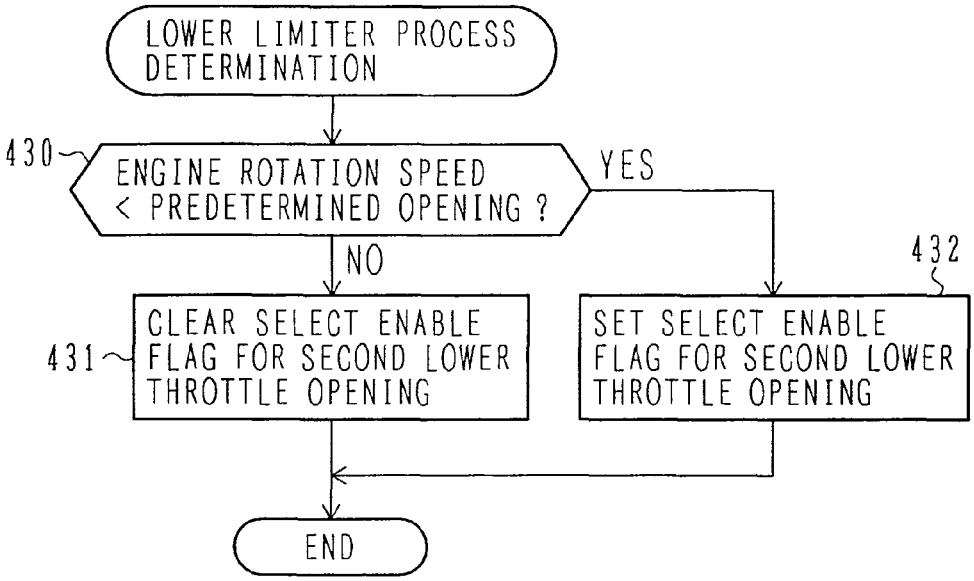
FIG. 14 shows a fourth method of lower limiter determination.

The lower limiter determination method of the fourth embodiment is different from that of the first embodiment. The following describes FIG. 14 where its flowchart is shown.

It is judged whether the engine rotation speed is smaller than a predetermined rotation speed (step 430). When the engine rotation speed is smaller than the predetermined rotation speed, the throttle valve is not likely to overshoot. In this case (yes), an enable flag to select a second lower limiter is set (step 432) before the sequence is completed. If not smaller (no), the enable flag to select the second lower limiter is cleared (step 431) before the sequence is completed.

Figure 15:
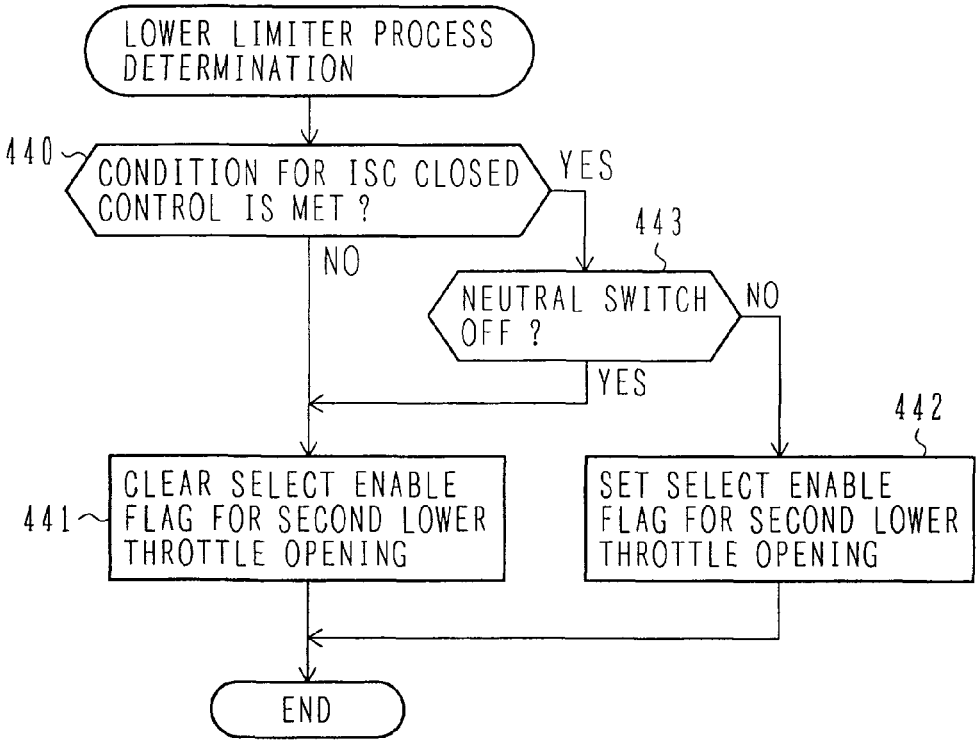
FIG. 15 shows a method of selecting a second lower limit.

While the lower limiter determination method of each of the first through fourth embodiments is described so far, FIG. 15 shows another method. In this method, as described below, when the shift lever is not in range N or P, the first lower limit is set as the lower limit since the engine load is high and the throttle opening need not be reduced.

It is judged whether the ISC closed control condition is met (step 440). If not met (no), the enable flag to select the second lower limiter is cleared (step 441) before the sequence is completed.

If the ISC closed control condition is met (yes), it is judged whether the neutral switch 17 is off, that is, the shift lever is neither in N nor P (step 443). If off (yes), the enable flag to select the second lower limiter is cleared (step 441) before the sequence is completed.

If on (no), the enable flag to select the second lower limiter is set (step 442) before the sequence is completed.

In the above method, it is judged that the engine load is high and the throttle valve opening need not be reduced when the neutral switch is off. Alternatively, this judgment may also be done when the air conditioner switch 18 is on or the accessory load is higher than a predetermined threshold.

It is also possible to judge that the throttle opening need not be reduced when the mechanical stopper position of the throttle valve 40 has yet to be learnt or when the throttle valve controller is found abnormal.

While a first lower limiter is selected if the enable flag to select a second lower limiter is cleared in the above examples, this scheme may also be modified so that a third lower limit larger than the first lower limit is selected in this case (not shown).

Such a third lower limit may be predefined by taking into consideration (a) throttle position sensor detection error, (b) throttle valve mounting error, (c) throttle valve mounting tolerance and/or (d) default throttle opening. This makes it possible to prevent the throttle valve from bumping regardless of machine to machine variations.

Figure 16:
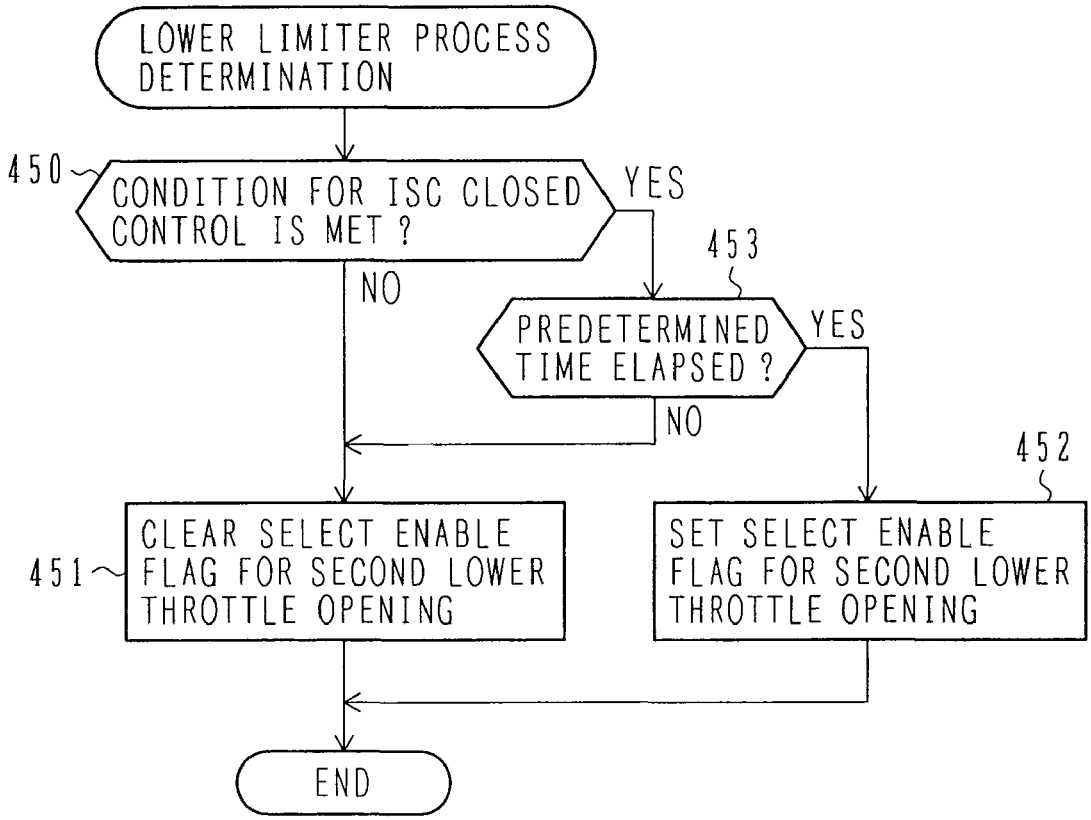
FIG. 16 shows a method of not selecting a second lower limit until a certain amount of time passes.

In the first through fourth embodiments, the lower limiter determination condition becomes true and false unstably as the case may be. In FIG. 16, as described below, the second lower limiter may be selected only if the condition for selecting the second lower limiter continues to be true for a predetermined period of time so as not to cause abrupt changes of the lower limit.

It is judged whether the ISC closed control condition is met (step 450). If not met (no), the enable flag to select the second lower limiter is cleared (step 451) before the sequence is completed.

If the ISC closed control condition is met (yes), it is judged whether a predetermined period of time has passed (step 453). If no, the enable flag to select the second lower limiter is cleared (step 451) before the sequence is completed. If yes, the enable flag to select the second lower limiter is set (step 452) before the sequence is completed.

Instead of judging whether a certain period of time has passed, abrupt changes of the lower limit may also be prevented by lowering the lower limit to the second lower limit at a predetermined rate.

Figure 17:
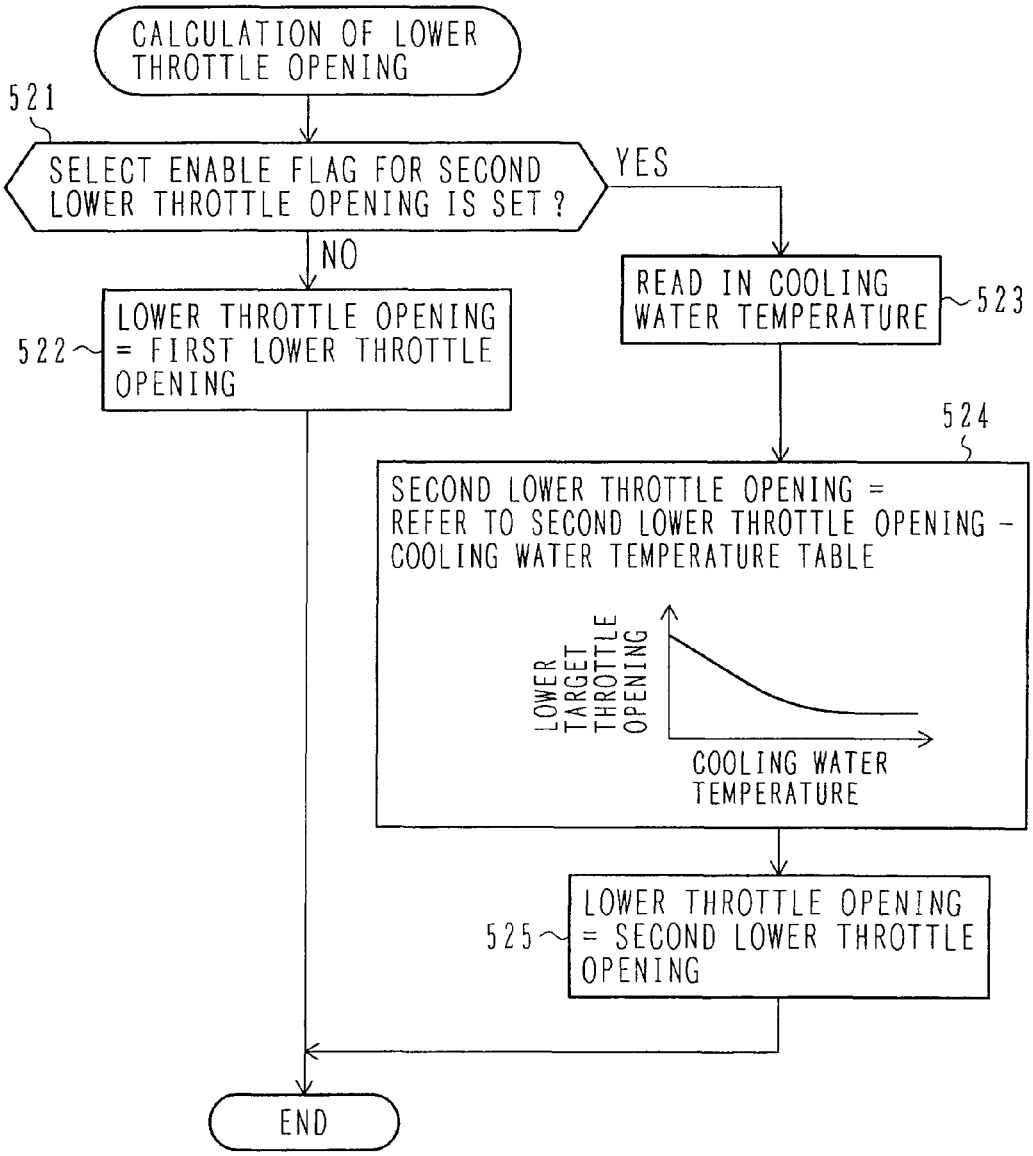
FIG. 17 shows a method of calculating a second lower limit according to the cooling water temperature.

Then, as described below, FIG. 17 shows a method of calculating the second lower limit depending on the temperature of the cooling water.

In this lower limit calculation method, it is judged whether the enable flag to select the second lower limiter is set (step 521). If the enable flag to select the second lower limiter is set (yes), the cooling water temperature is read in (step 523). Then, a lower limit appropriate for the cooling water temperature is retrieved as the second lower limit from a predefined second lower limit vs. water temperature table (step 524). In this table, as the cooling water temperature rises to lower the engine load, the second lower limit becomes smaller. Then, the retrieved second lower limit is set as the lower limit (step 525) before the sequence is completed.

If the enable flag to select the second lower limiter is not set (no), the first lower limit is set as the lower limit (step 522) before the sequence is completed.

Figure 18:
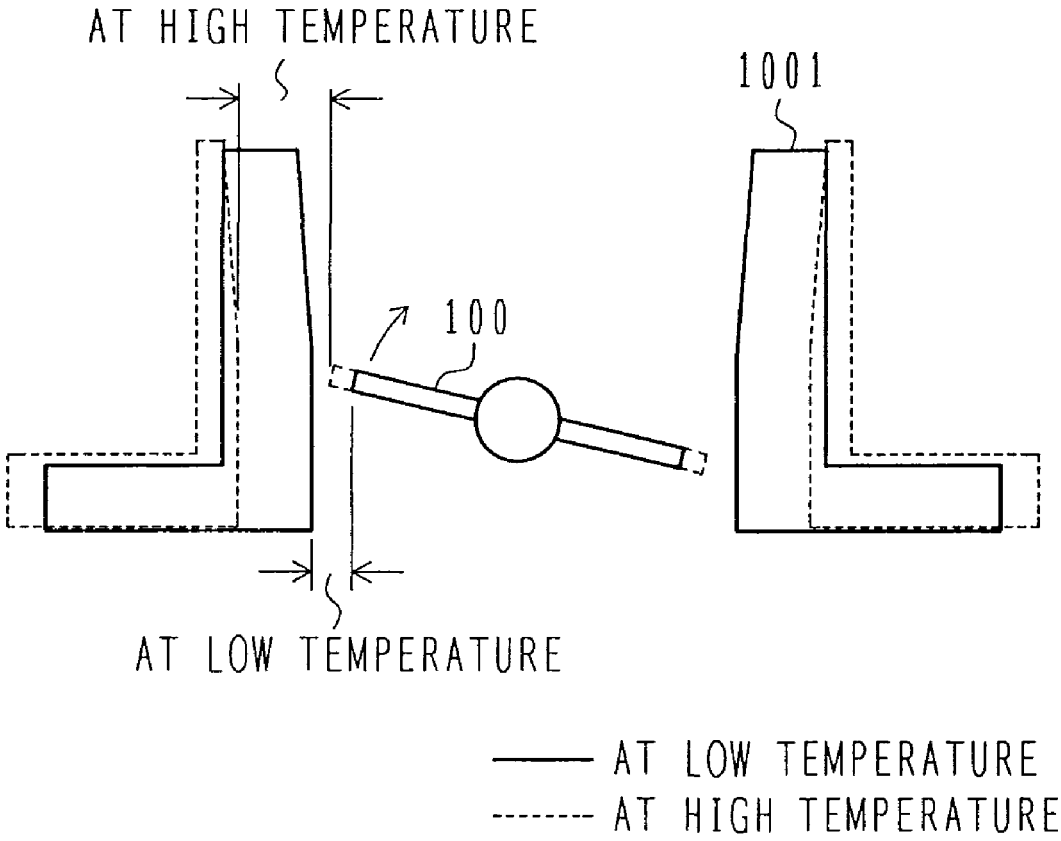
FIG. 18 shows the relation between the lower limiter and the cooling water temperature and intake air temperature.
Figure 19:
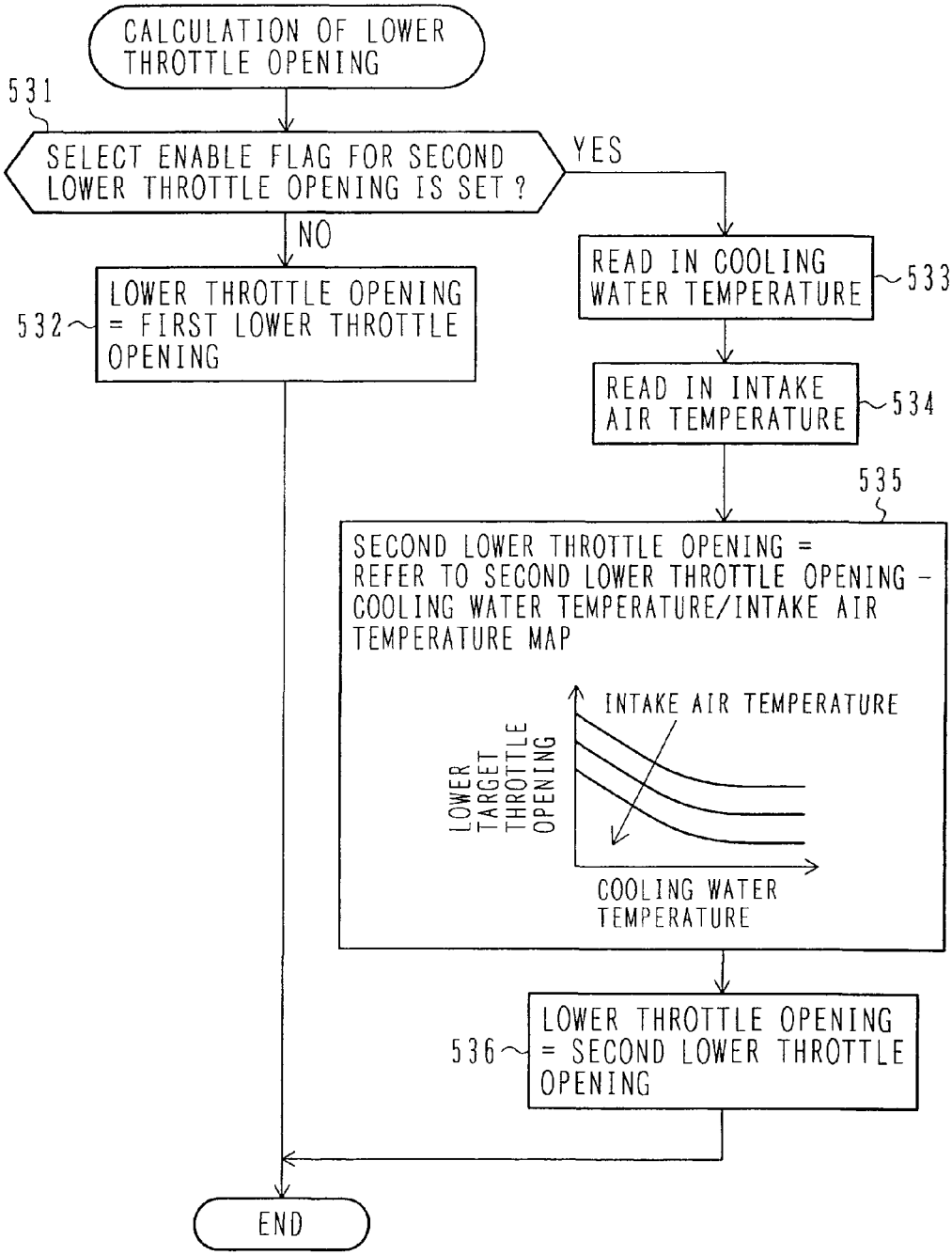
FIG. 19 is a flowchart of calculating a second lower limit according to the cooling water temperature and intake air temperature.

Then, as described below, FIGS. 18 and 19 show a method of calculating a second lower limit depending on the cooling water temperature and intake air temperature.

At first, FIG. 18 shows the relation between the lower limiter and the cooling water temperature and intake air temperature. Due to their difference of linear expansion, the clearance between the valve 1000 and the body 1001 which constitute the throttle valve changes depending on temperature. This means that the degree of opening of the throttle valve below which interference occurs changes. In this example, it is possible to set the lower limit of opening smaller at high temperature than at low temperature or set the lower limit of opening larger at low temperature than at high temperature. The temperature of the valve 1000 depends on the temperature in the air duct while the temperature of the body 1001 greatly depends on the temperature around the throttle valve 40. The ambient temperature around the throttle valve correlates with the cooling water temperature since the throttle valve is close to the engine cooling water. The temperature in the air duct correlates with the intake air temperature.

Thus, when the cooling water temperature is high, it is possible to set the lower limit smaller. Likewise, when the engine intake air temperature is low, it is possible to set the lower limit smaller.

Then, as described below, FIG. 19 shows a flowchart of a process to calculate the second lower limit depending on the cooling water temperature and intake air temperature.

In this lower limit calculation method, it is judged whether the enable flag to select the second lower limiter is set (step 531). If the enable flag to select the second lower limiter is set (yes), the cooling water temperature is read in (step 533) and the intake air temperature is read in (step 534). Then, a lower limit appropriate for the cooling water temperature and intake air temperature is retrieved as the second lower limit from a predefined second lower limit vs. cooling water temperature/intake air temperature map (step 536). In this map, as the cooling water temperature rises, the second lower limit becomes smaller. As well, as the intake air temperature rises, the second lower limit becomes larger. Further, since the influence of the intake air temperature is dependent on the air mass flow, the retrieved limit may be corrected according to the air mass flow. Then, the retrieved second lower limit is set as the lower limit (step 536) before the sequence is completed.

If the enable flag to select the second lower limiter is not set (no), the first lower limit is set as the lower limit (step 532) before the sequence is completed.

As described so far, it is possible according to the present invention to make smaller the lower limit of the target opening if overshoot is not likely to occur, for example, when the throttle valve operates slowly, when the engine is at idle, when the throttle valve is not so opened and when the engine rotation speed is low. Thus, the degree of opening of the throttle valve can be controlled more widely by changing the lower limit without causing overshoot/collision.

If the engine load is not likely to decrease, for example, when load is given by the torque converter with the shift lever not in range P or N, when the air conditioner is on and when accessory load such as electric load is given, the lower limit of the target opening is not made smaller since the engine power must be kept output. This throttle valve control can prevent overshoot and consequent collision, as well.

In addition, when the full close position of the throttle valve has yet to be learnt or when the throttle valve controller is found abnormal, the lower limit is not made smaller or is made larger since the throttle valve may collide at the full close position. This throttle valve control can prevent overshoot and consequent collision, as well.

It is also possible to prevent the delay of the actual throttle position from having influence on the throttle valve control by not switching the lower limiter until a certain period of time passes after the switching condition becomes true.

Further, when the lower limit is made smaller, the new lower limit can be calculated by taking into consideration the cooling water temperature and intake air temperature. This can compensate for the shift of the throttle valve's full close position due to thermal expansion.

What is claimed is:

1. A throttle valve controller for an internal combustion engine, comprising:

a throttle valve which is driven by a motor;

means for determining the target opening and target throttle change speed of said throttle valve based on the operating state of a vehicle or internal combustion engine;

means for providing a first lower limit which is determined beforehand as the minimum target opening, and for setting a second lower limit which is smaller than the first lower limit if the determined target throttle change speed is lower than a predetermined speed; and wherein if at least one of the shift lever is not in range N or P, if the air conditioner is on and the accessory load is larger than a predetermined level, one of the first lower limit and a third lower limit larger than the first lower limit is set even if the condition for setting the second lower limit is met.

2. A throttle valve controller for an internal combustion engine, comprising:

a throttle valve which is driven by a motor;

means for determining the target opening and target throttle change speed of said throttle valve based on the operating state of a vehicle or internal combustion engine;

means for providing a first lower limit which is determined beforehand as the minimum target opening, and for setting a second lower limit which is smaller than the first lower limit if the determined target throttle change speed is lower than a predetermined speed; and further comprising stopper position learning means which learns the mechanical stopper position corresponding to an opening smaller than the second limit of the throttle valve, wherein if the stopper position learning means has yet to learn the mechanical stopper position, the first lower limit or a third lower limit larger than the first lower limit is set even if the condition for setting the second lower limit is met.

3. A throttle valve controller for an internal combustion engine, comprising:

a throttle valve which is driven by a motor;

means for determining the target opening and target throttle change speed of said throttle valve based on the operating state of a vehicle or internal combustion engine;

means for providing a first lower limit which is determined beforehand as the minimum target opening, and for setting a second lower limit which is smaller than the first lower limit if the determined target throttle change speed is lower than a predetermined speed; and further comprising means for checking if the throttle valve controller is abnormal, wherein if the throttle valve controller is being checked, one of the first lower limit and a third lower limit larger than the first lower limit is set even if the condition for setting the second lower limit is met.

4. A throttle valve controller for an internal combustion engine comprising:

a throttle valve which is driven by a motor;

means for determining the target opening and target throttle change speed of said throttle valve based on the operating state of a vehicle or internal combustion engine;

means for providing a first lower limit which is determined beforehand as the minimum target opening, and for setting a second lower limit which is smaller than the first lower limit if the determined target throttle change speed is lower than a predetermined speed; and further comprising means for checking if the throttle valve controller is abnormal, wherein if the throttle valve controller is found abnormal, one of the first lower limit and a third lower limit larger than the first lower limit is set even if the condition for setting the second lower limit is met.

* * * * *